US007903102B2

(12) United States Patent
Chae et al.

(10) Patent No.: US 7,903,102 B2
(45) Date of Patent: Mar. 8, 2011

(54) DISPLAY DRIVING INTEGRATED CIRCUIT AND METHOD

(75) Inventors: Jeong-seok Chae, Suwon-si (KR); Jeong-su Kang, Suwon-si (KR); Jae-sung Kang, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 878 days.

(21) Appl. No.: 11/525,229

(22) Filed: Sep. 21, 2006

(65) Prior Publication Data

US 2007/0097050 A1 May 3, 2007

(30) Foreign Application Priority Data

Sep. 21, 2005 (KR) ..... 10-2005-0087856

(51) Int. Cl.
*G09G 5/00* (2006.01)

(52) U.S. Cl. ..... 345/204; 345/77; 345/89; 345/690

(58) Field of Classification Search ..... 345/76, 345/87, 98–100, 204, 205, 206, 77, 89, 690
See application file for complete search history.

(56) References Cited

U.S. PATENT DOCUMENTS 6,097,362 A * 8/2000 Kim ..... 345/87
6,335,721 B1 * 1/2002 Jeong ..... 345/100
7,038,652 B2 * 5/2006 Kang et al. ..... 345/98
7,081,877 B2 * 7/2006 Bu et al. ..... 345/98
7,176,864 B2 * 2/2007 Moriyama et al. ..... 345/87
7,180,497 B2 * 2/2007 Lee et al. ..... 345/98
7,180,499 B2 * 2/2007 Lee et al. ..... 345/100
7,245,283 B2 * 7/2007 Kim et al. ..... 345/100
7,375,709 B2 * 5/2008 Toriumi et al. ..... 345/89
7,385,544 B2 * 6/2008 Chia ..... 341/144
7,440,702 B2 * 10/2008 Imai ..... 398/141
7,551,155 B2 * 6/2009 Fukuda et al. ..... 345/98
2004/0056852 A1 * 3/2004 Shih et al. ..... 345/204
2006/0050044 A1 * 3/2006 Ikeda ..... 345/98
2006/0055656 A1 * 3/2006 Chung ..... 345/100
2006/0077137 A1 * 4/2006 Kwon ..... 345/76
2006/0232541 A1 * 10/2006 Kudo et al. ..... 345/98

FOREIGN PATENT DOCUMENTS

JP 10-066062 3/1998

(Continued)

*Primary Examiner*—Regina Liang
*Assistant Examiner*—Tom V Sheng
(74) *Attorney, Agent, or Firm*—F. Chau & Associates, LLC

(57) ABSTRACT

A display driving integrated circuit (IC) capable of reducing the number of transmission lines for transmitting gray-scale data from a memory. The display driving IC receives M-bit gray-scale data to represent the gray scale of one pixel and drives a panel including a plurality of pixels. The display driving IC includes a memory storing gray-scale data representing the gray scales of the plurality of pixels, a source driver receiving the gray-scale data from the memory through transmission lines and transmitting the received gray-scale data to the panel, and at least one multiplexer to transmit the M-bit gray-scale data representing the gray scale of one pixel through L transmission lines, wherein the value of L is smaller than the value of M.

17 Claims, 6 Drawing Sheets

FOREIGN PATENT DOCUMENTS

| | | |
|---|---|---|
| JP | 2000-155552 | 6/2000 |
| JP | 2003-195820 | 7/2003 |
| JP | 2004-279595 | 10/2004 |
| KR | 100239413 | 10/1999 |
| KR | P1999-0075483 | 10/1999 |
| KR | 1020040081705 | 9/2004 |

* cited by examiner

DISPLAY DRIVING INTEGRATED CIRCUIT AND METHOD

CROSS-REFERENCE TO RELATED PATENT APPLICATION

This application claims priority to Korean Patent Application No. 10-2005-0087856, filed on Sep. 21, 2005, the disclosure of which is herein incorporated by reference in its entirety.

BACKGROUND OF THE INVENTION

1. Technical Field

The present disclosure relates to an integrated circuit (IC) and method for driving a display and, more particularly, to a display driving IC capable of reducing the number of transmission lines for transmitting gray-scale data from a memory and a display driving method thereof.

2. Discussion of the Related Art

Liquid crystal display (LCD) devices are widely used for information processing devices such as notebook computers, PDAs and monitors. An LCD comprises a liquid crystal panel having a thin film transistor (TFT) substrate on which a TFT is formed, a color filter substrate on which a color filter layer is formed, and a liquid crystal layer interdisposed between the two substrates. An LCD device displays an image by applying a controlled electric field to the liquid crystal layer to control the alignment of the liquid crystal and the quantity of light transmitted.

An LCD panel includes pixels formed at the intersections of a plurality of scan lines for transferring a gate select signal and a plurality of data lines for transferring color data or gray-scale data.

Driving ICs for driving a display device such as an LCD commonly include a scan driver for driving the scan lines and a source driver for driving the data lines. The scan driver and the source driver can be integrated into a single chip. An example of a source driver circuit for an LCD is disclosed in U.S. Pat. No. 6,747,626. In the '626 patent, a source driver circuit for driving an LCD includes a shift register, a plurality of data inputs connected to the source driver circuit for receiving input data indicative of an image to be displayed on the LCD, a plurality of sample registers coupled to the shift register, and hold registers coupled to the sample registers.

FIG. 1A is a block diagram of a conventional display driving IC 20. Referring to FIG. 1A, the driving IC 20 for driving a panel 10 includes a source driver 21*a* and a memory 22*a*. The driving IC 20 receives a control signal CON from an external controller 30 and drives the panel 10. The memory 22*a* stores gray-scale data corresponding to frames of images to be displayed on the panel 10. The gray-scale data is transmitted to the source driver 21*a* through a scan port of the memory 22*a*. In this case, all of the bits of the gray-scale data representing a gray scale of one pixel are transmitted in parallel.

In general, the size of the memory 22*b* decreases as the LCD becomes smaller, but, as shown in FIG. 1B, reduction in the size of the source driver 21*b* is limited, for example, due to the voltage applied to the source driver 21*b*. The required wiring space increases the height of the chip in which the driving IC is formed, and an increase in height is often not an acceptable option.

SUMMARY OF THE INVENTION

Exemplary embodiments of the present invention generally include display driving integrated circuits capable of reducing the number of transmission lines for transferring gray-scale data from a memory.

According to an exemplary embodiment of the present invention, there is provided a display driving integrated circuit (IC) receiving M-bit gray-scale data to represent the gray scale of one pixel and driving a panel including a plurality of pixels. The display driving IC includes a memory storing gray-scale data representing the gray scales of the plurality of pixels, a source driver receiving the gray-scale data from the memory through transmission lines and transmitting the received gray-scale data to the panel, and at least one multiplexer to transmit the M-bit gray-scale data representing the gray scale of one pixel through L transmission lines, wherein the value of L is smaller than the value of M. The at least one multiplexer may be disposed between the memory and the transmission lines.

The display driving IC may further include at least one demultiplexer receiving gray-scale data through the L transmission lines, demultiplexing the received gray-scale data into M-bit gray-scale data and transmitting the M-bit gray-scale data to the source driver. The at least one demultiplexer may be disposed between the transmission lines and the source driver.

Each of the at least one multiplexer may receive M/L-bit gray-scale data and sequentially output the M/L-bit gray-scale data bit by bit through one transmission line, where M/L is an integer.

Each of the at least one demultiplexer may sequentially receive the M/L-bit gray-scale data bit by bit through a transmission line and output the M/L-bit gray-scale data in parallel.

Each of the at least one demultiplexer may include at least one latch for parallel outputting the gray-scale data.

The display driving IC may further include a control signal generator generating signals controlling the multiplexer and the demultiplexer such that the multiplexer and the demultiplexer transmit and receive the gray-scale data.

The control signals may include M/L signals respectively transmitted through M/L lines, where M/L is an integer. The control signal generator may generate the M/L control signals in synchronization with K input signals.

According to an exemplary embodiment of the present invention, there is provided a display driving IC receiving M-bit gray-scale data to represent the gray scale of one pixel and driving a panel including a plurality of pixels. The display driving IC includes a memory storing gray-scale data representing the gray scales of the plurality of pixels, and a source driver receiving the gray-scale data from the memory through transmission lines and transmitting the received gray-scale data to the panel. The M-bit gray-scale data representing the gray scale of one pixel is transmitted through L transmission lines,. wherein the value of L is smaller than the value of M. The M/L-bit gray-scale data, from among the gray-scale data is time-divided and sequentially transmitted bit by bit through one of the L transmission lines, where M/L is an integer.

According to an exemplary embodiment of the present invention, there is provided a method for receiving M-bit gray-scale data to represent the gray scale of one pixel and driving a panel including a plurality of pixels. The method comprises reading gray-scale data stored in a memory, multiplexing the read gray-scale data to transmit the M-bit gray-scale data representing the gray scale of one pixel through L transmission lines, the value of L being smaller than the value of M, transmitting the multiplexed gray-scale data through the L transmission lines, receiving the gray-scale data through the L transmission lines and demultiplexing the received gray-scale data into M-bit gray-scale data, and parallel transmitting the demultiplexed M-bit gray-scale data to a source driver.

BRIEF DESCRIPTION OF THE DRAWINGS

The present invention will become readily apparent to those of ordinary skill in the art when descriptions of exemplary embodiments thereof are read with reference to the accompanying drawings.

DESCRIPTION OF EXEMPLARY EMBODIMENTS

Figure 1A:
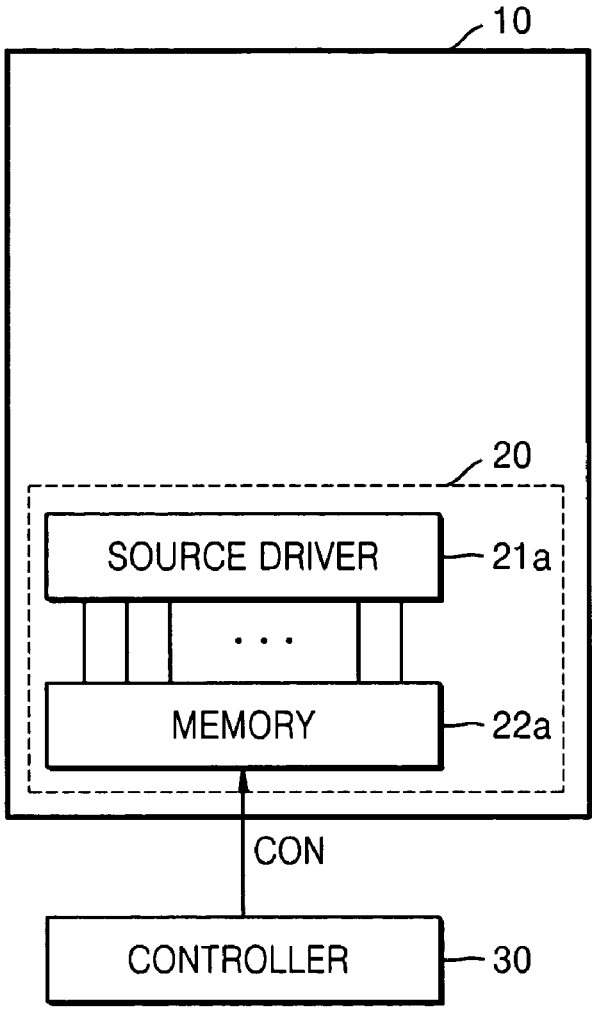
FIG. 1A (PRIOR ART)
FIGS. 1A and 1B are block diagrams of conventional display driving ICs.
Figure 1B:
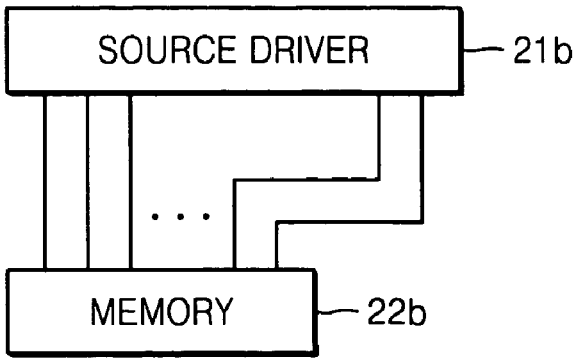
FIG. 1B (PRIOR ART)

Hereinafter, exemplary embodiments of the present invention will be described in detail with reference to the accompanying drawings. Like reference numerals refer to similar or identical elements throughout the description of the figures.

Figure 2:
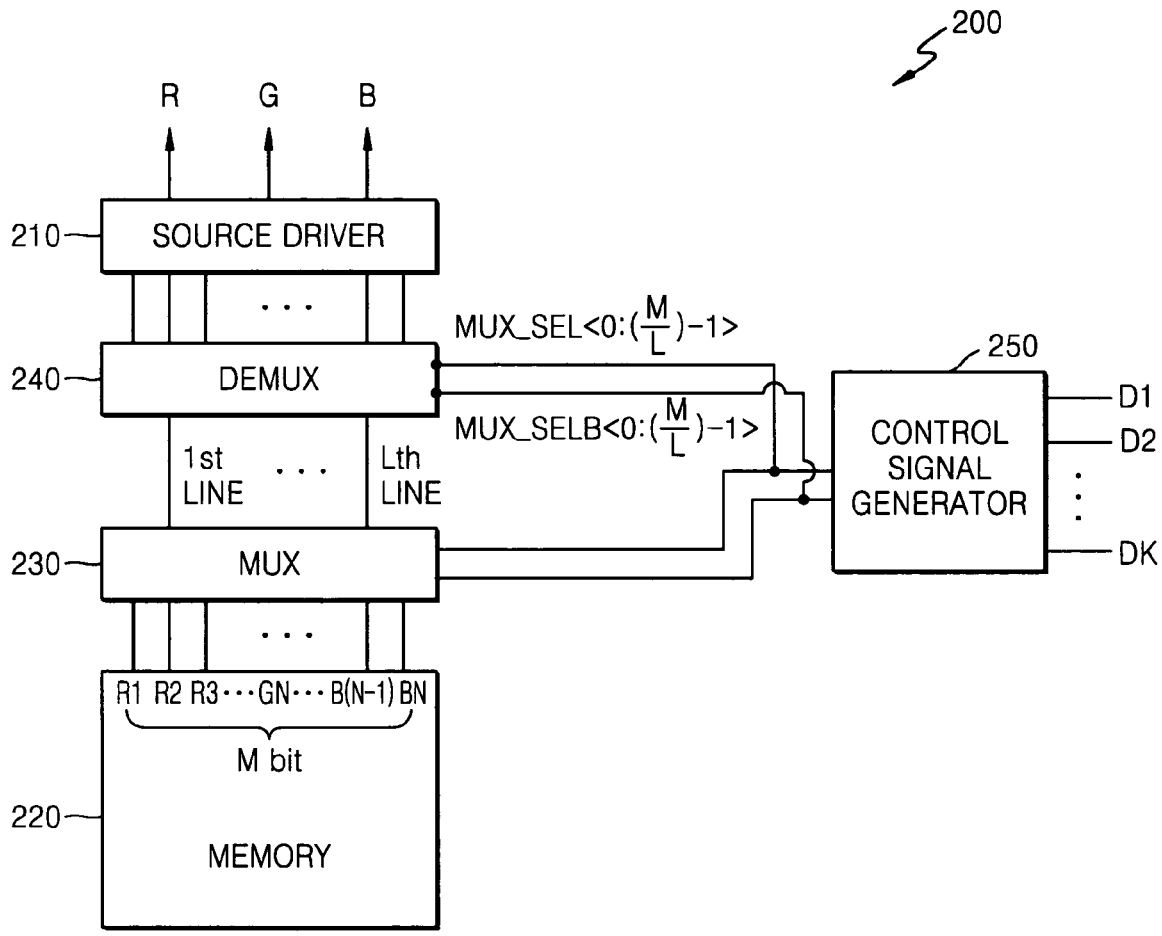
FIG. 2 is a block diagram of a display driving IC according to an exemplary embodiment of the present invention.

FIG. 2 is a block diagram of a display driving IC 200 according to an exemplary embodiment of the present invention. Referring to FIG. 2, the display driving IC 200 includes a source driver 210, a memory 220, a multiplexer 230, and a demultiplexer 240. The display driving IC 200 may further include a control signal generator 250 for controlling the multiplexer 230 and/or the demultiplexer 240.

The memory 220 stores data such as frames of gray-scale data indicative of an image to be displayed on a panel. An image can be generated from M-bit gray-scale data for each pixel included in the panel. The M-bit gray-scale data may comprise, for example, N-bit red gray-scale data R1 through RN, N-bit green gray-scale data G1 through GN, and N-bit blue gray-scale data B1 through BN.

The gray-scale data stored in the memory 220 is read and transmitted through a scan port included in the memory 220. FIG. 2 shows the transmission of the M-bit gray-scale data corresponding to one pixel.

The M-bit gray-scale data read from the memory 220 is inputted to the multiplexer 230. The multiplexer 230 receives the M-bit gray-scale data and transmits the M-bit gray-scale data through L transmission lines. In an exemplary embodiment of the present invention, the value of L is smaller than the value of M. To transmit the M-bit gray-scale data through the L transmission lines, L M/L-to-1 multiplexers can be used. For example, in the case when the M-bit gray-scale data is 18-bit gray-scale data comprising 6-bit red gray-scale data, 6-bit green gray-scale data and 6-bit blue gray-scale data, two 9-to-1 multiplexers can be used to transmit the 18-bit gray-scale data through two transmission lines.

The gray-scale data transmitted through the L transmission lines is inputted to the demultiplexer 240. As shown in FIG. 2, the demultiplexer 240 may be disposed between the transmission lines and the source driver 210. The demultiplexer 240 demultiplexes the gray-scale data transmitted through the L transmission lines into M-bit gray scale data and transmits the demultiplexed M-bit gray-scale data to the source driver 210. In an exemplary embodiment of the present invention, the demultiplexer 240 is operated in connection with the multiplexer 230. For example, L 1-to-M/L demultiplexers are used when the L M/L-to-1 multiplexers are used.

The M-bit gray-scale data transmitted to the source driver 210 is transmitted to pixels of the panel through a plurality of data lines to construct an image according to R, G and B data.

The control signal generator 250 generates control signals MUX_SEL<0:(M/L)-1> and MUX_SELB<0:(M/L)-1> for controlling the multiplexer 230 and the demultiplexer 240. The control signal MUX_SELB<0:(M/L)-1> can be obtained by inverting the control signal MUX_SEL<0:(M/L)-1>. For example, in the case when the M-bit gray-scale data is 18-bit data and is transmitted through two transmission lines, the multiplexer 230 and the demultiplexer 240 are controlled by nine control signals MUX_SEL<0:8> and nine inverted control signals MUX_SELB<0:8>.

To ensure correct data transmission between the multiplexer 230 and the demultiplexer 240, the control signal generator 250 receives K input signals D1 through DK and generates the control signals MUX_SEL<0:(M/L)-1> and MUX_SELB<0:(M/L)-1> in synchronization with the input signals D1 through DK. For example, when 18-bit gray-scale data is transmitted through two transmission lines, nine control signals MUX_SEL<0:8> and four input signals D1 through D4 are required.

Operations of the multiplexer 230 and the demultiplexer 240 according to an exemplary embodiment of the present invention will now be explained in detail with reference to FIG. 3.

Figure 3:
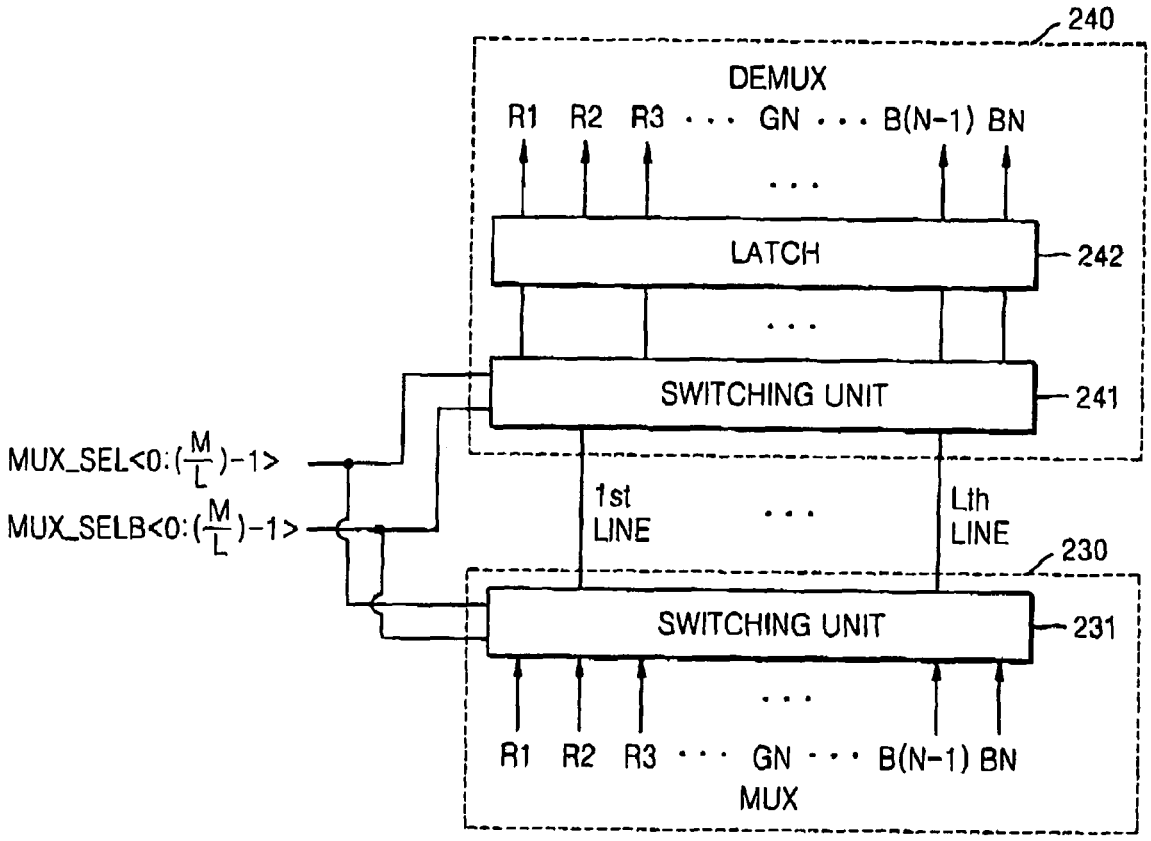
FIG. 3 is a block diagram of the multiplexer and the demultiplexer shown in FIG. 2, according to an exemplary embodiment of the present invention.

FIG. 3 is a block diagram of the multiplexer 230 and the demultiplexer 240 shown in FIG. 2, according to an exemplary embodiment of the present invention. Referring to FIG. 3, the multiplexer 230 multiplexes M (3N) bit gray-scale data and outputs the multiplexed data through L transmission. lines. In this case, the multiplexer 230 can include L M/L-to__1 multiplexers.

The multiplexer 230 includes a switching unit 231. The switching unit 231 controls the transmission of the gray-scale data in response to the control signals MUX_SEL<0:(M/L)-1> and the inverted control signals MUX_SELB<0:(M/L)-1>. The switching unit 231 includes M switches (not shown) corresponding to the M-bit gray-scale data. A M/L-to-1 multiplexer includes M/L switches respectively controlled by the control signals MUX_SEL<0:(M/L)-1> and the inverted control signals MUX_SELB<0:(M/L)-1>.

For example, when 18-bit gray-scale data representing the gray scale of one pixel is transmitted through two transmission lines, two 9-to-1 multiplexers are needed. Each of the 9-to-1 multiplexers may include nine switches which are sequentially switched by nine control signals MUX_SEL<0> through MUX_SEL<8> and nine inverted control signals MUX_SELB<0> through MUX_SELB<8>.

As the switches are sequentially switched, the gray-scale data is time-divided and sequentially transmitted through the transmission lines. In the case of a 9-to-1 multiplexer, the nine switches respectively controlling the transmission of nine gray-scale data bits are sequentially switched such that the nine gray-scale data bits are sequentially transmitted through one transmission line.

The multiplexer 230 can include a latch (not shown) for holding the gray-scale data. The M gray-scale data may be simultaneously input to the switching unit 231.

The demultiplexer 240 demultiplexes the gray-scale data transmitted through the transmission lines into M-bit gray-scale data: When the multiplexer 230 includes L M/L-to-1 multiplexers, the demultiplexer 240 is composed includes L 1-to-M/L demultiplexers.

The demultiplexer 240 can include a switching unit 241 and a latch 242. The gray-scale data transmitted through the transmission lines is inputted to the switching unit 241 included in the demultiplexer 240.

The switching unit 241 includes M switches (not shown) corresponding to the M-bit gray-scale data. The switching unit 241 controls the input of the M-bit gray-scale data in response to the control signals MUX_SEL<0:(M/L)-1> and the inverted control signals MUX_SELB<0:(M/L)-1>. The switches of the multiplexer 230 and the switches of the demultiplexer 240 are controlled by the control signals MUX_SEL<0:(M/L)-1> and the inverted control signals MUX_SELB<0:(M/L)-1>. The switches of the multiplexer 230 are sequentially switched to transmit the gray-scale data through the transmission lines, and the switches of the demultiplexer 240 are sequentially switched to receive the transmitted gray-scale data.

In an exemplary embodiment of the present invention, the demultiplexer 240 includes two 1-to-9 demultiplexers when the multiplexer 230 includes two 9-to-1 multiplexers. Nine switches included in each of the 1-to-9 demultiplexers are sequentially switched as the nine switches included in each of the 9-to-1 multiplexers are sequentially switched.

The gray-scale data input to the switching unit 241 is temporarily held in the latch 242, restored into the M-bit gray-scale data and output to the source driver.

Operations of the multiplexer and the demultiplexer according to an exemplary embodiment of the present invention will now be explained in detail with reference to FIG. 4.

Figure 4:
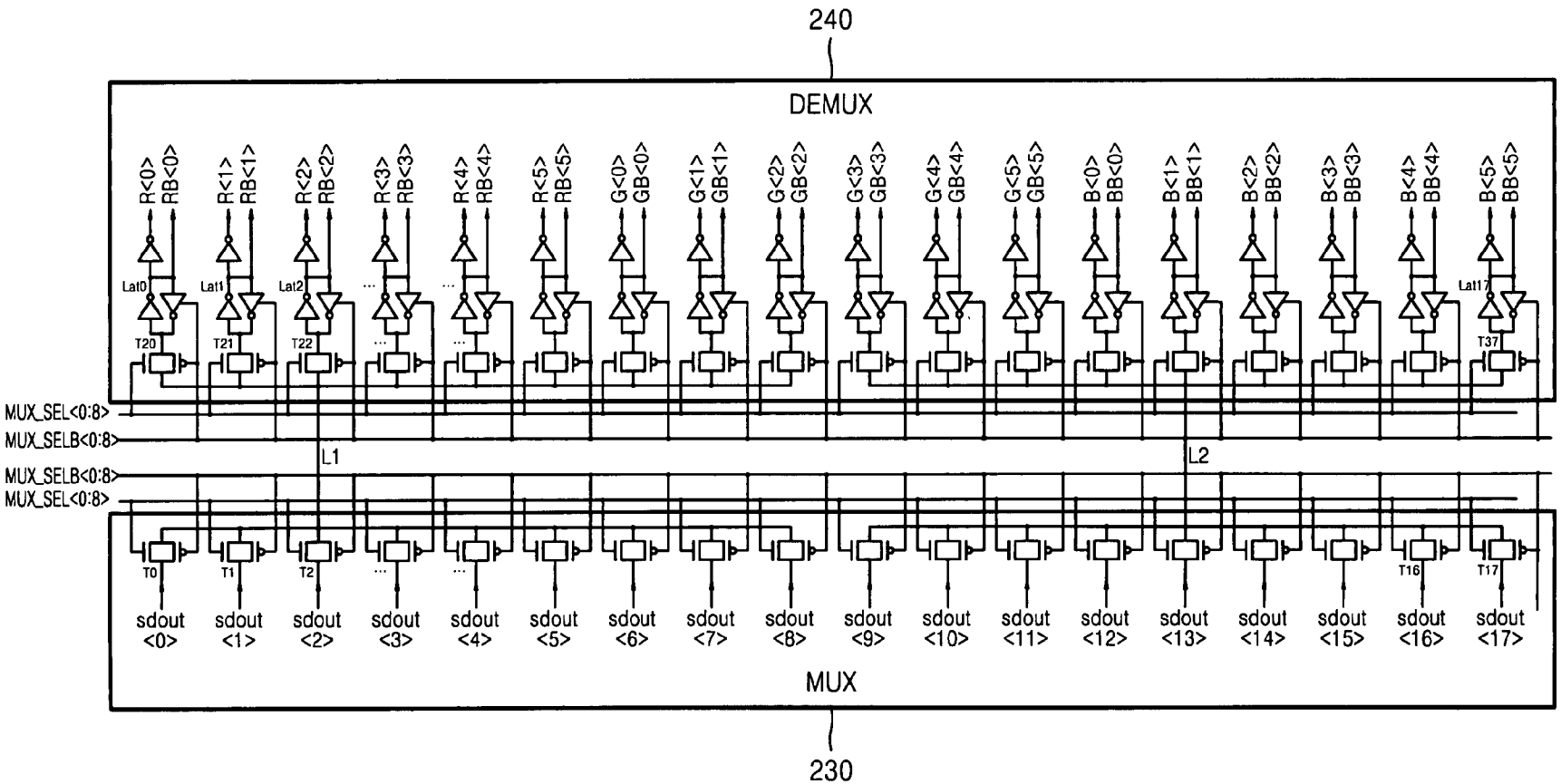
FIG. 4 is a circuit diagram of the multiplexer and the demultiplexer shown in FIG. 2, according to an exemplary embodiment of the present invention.

FIG. 4 is a circuit diagram of the multiplexer 230 and the demultiplexer 240 shown in FIG. 2, according to an exemplary embodiment of the present invention. Referring to FIG. 4, the gray scale of one pixel can be represented by 18-bit gray-scale data comprising 6-bit red gray-scale data, 6-bit green gray-scale data and 6-bit blue gray-scale data. Two transmission lines L1 and L2 can be used to time-divide the 18-bit gray-scale data and serially transmit the time-divided 18-bit gray-scale data.

The 18-bit gray-scale data sdout<0> through sdout<17> read from a memory is inputted to the multiplexer 230. The multiplexer 230 includes two 9-to-1 multiplexers. For example, 9-bit gray-scale data sdout<0> through sdout<8> is transmitted through one transmission line L1 and the other 9-bit gray-scale data sdout<9> through sdout<17> is transmitted through the other transmission line L2.

In FIG. 4, the two 9-to-1 multiplexers respectively include nine switching elements. For example, one of the 9-to-1 multiplexer includes nine transfer gates T0 through T8 and the other 9-to-1 multiplexer includes nine transfer gates T9 through T17.

Hereinafter, operations of the 9-to-1 multiplexer and the demultiplexer in accordance with an exemplary embodiment of the present invention will be explained.

The nine gray-scale data bits sdout<0> through sdout<8> are respectively input to the transfer gates T0 through T8 of the 9-to-1 multiplexer. The transfer gates T0 through T8 are gated by the control signals MUX_SEL<0:8> and the inverted control signals MUX_SELB<0:8>.

The transfer gates T0 through T8 receive the control signals MUX_SEL<0:8> and the inverted control signals MUX_SELB<0:8> through control signal lines (not shown). The control signal lines may include nine lines. The control signals MUX_SEL<0> through MUX_SEL<8> can be respectively input through the nine control signal lines. The control signal lines transmitting the inverted control signals may include nine lines. The inverted control signals MUX_SELB<0> through MUX_SELB<8> can be respectively input through the nine control signal lines.

The control signals MUX_SEL<0:8> and the inverted control signals MUX_SELB<0:8> sequentially gate the nine transfer gates T0 through T8. For example, the first transfer gate T0 is gated to first transfer one gray-scale data bit sdout<0> to the demultiplexer 240 through the transmission line L1. Then, the first transfer gate T0 is turned off and the second transfer gate T1 is gated to transfer the next gray-scale data bit sdout<1> through the transmission line L1. Operation continues in this manner, until the final ninth transfer gate T8 is gated to transfer the gray-scale data bit sdout<8>. The nine gray-scale data bits sdout<0> through sdout<8> are time-divided and serially transmitted through one transmission line L1.

The demultiplexer 240, according to an exemplary embodiment of the present invention, includes two 1-to-9 demultiplexers each having nine switching elements. For example, one of the 1-to-9 demultiplexer includes transfer gates T20 through T28 and the other 1-to-9 demultiplexer includes transfer gates T29 through T37.

One of the 1-to-9 demultiplexers includes the nine transfer gates T20 through T28 controlled by the control signals MUX_SEL<0:8> and the inverted control signals MUX_SELB<0:8>. The transfer gates T20 through T28 are gated in connection with the transfer gates T0 through T8 included in the multiplexer.

When the transfer gate T0 of the multiplexer is gated to transfer the first gray-scale data bit sdout<0>, the transfer gate T20 of the demultiplexer 240 is gated to receive the first gray-scale data bit sdout<0>. The received gray-scale data bit sdout<0> is held by a latch Lat0. The latch Lat0 is operated by the inverted control signal MUX_SEL<0> to hold the first gray-scale data bit sdout<0> while the other gray-scale data bits sdout<1> through sdout<8> are transmitted.

Then, the transfer gate T1 of the multiplexer 230 and the transfer gate T21 of the demultiplexer 240 are gated by the control signals MUX_SEL<0:8> and the inverted control signals MUX_SELB<0:8>. The demultiplexer 240 receives the next gray-scale data bit sdout<1> and a latch Lat1 holds the gray-scale data bit sdout<1>. The nine gray-scale data bits sdout<0> through sdout<8> can be output in parallel to the source driver.

Figure 5:
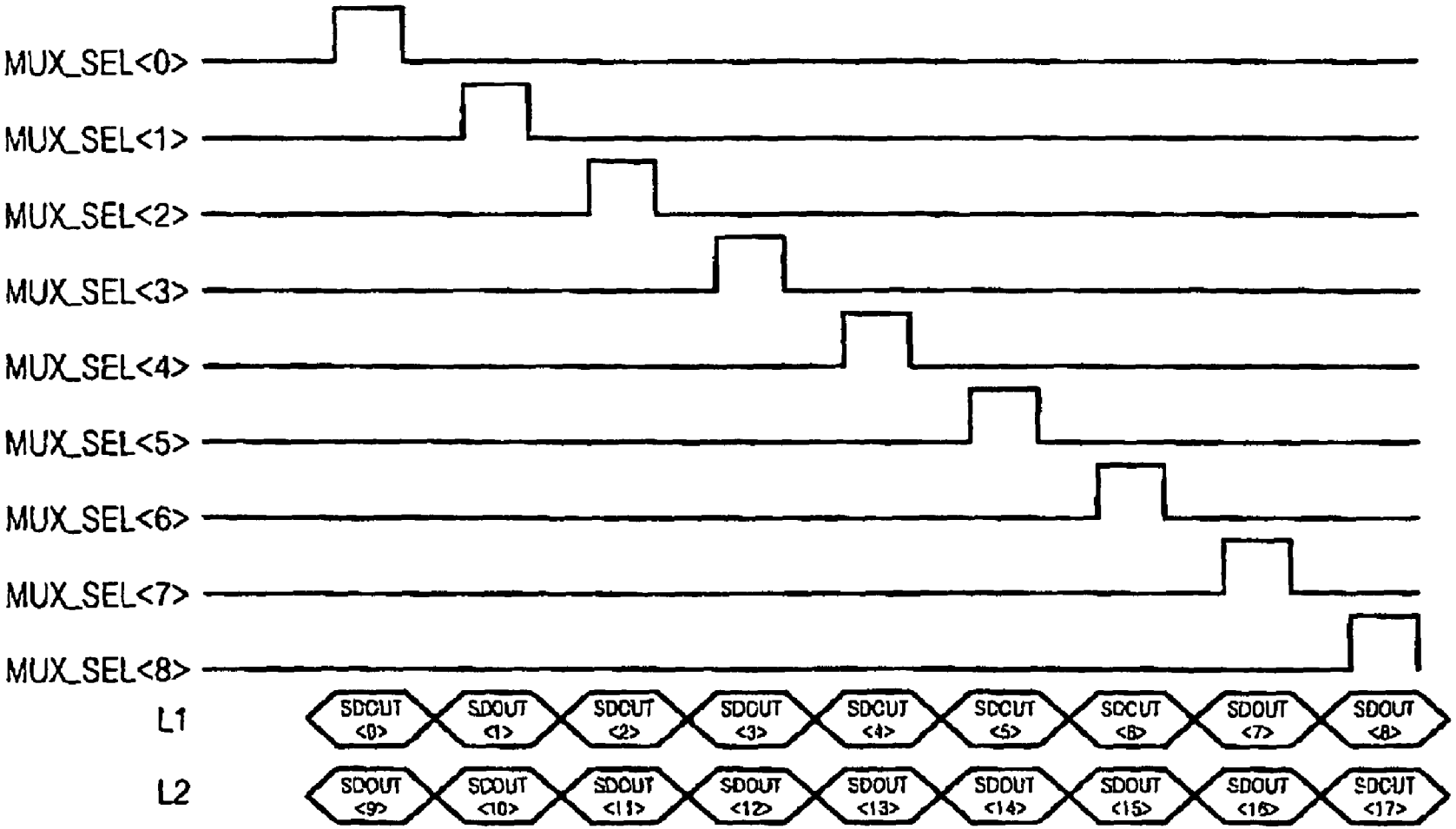
FIG. 5 illustrates the waveforms of control signals for driving the circuit of FIG. 4, and transmitted gray-scale data.

FIG. 5 illustrates the waveforms of control signals for driving the circuit of FIG. 4, and transmitted gray-scale data. The waveforms shown in FIG. 5 will now be explained with reference to FIG. 4.

When the control signal MUX_SEL<0> is shifted to a high level, the transfer gates T0 and T9 of the two 9-to-1 multiplexers are gated and the transfer gates T20 and T29 of the two 1-to-9 demultiplexers are gated. The first gray-scale data bits sdout<0> and sdout<9> input to the respective multiplexers are respectively transmitted to the demultiplexers through the two transmission lines L1 and L2. Subsequently, as the control signals MUX_SEL<1> through MUX_SEL<8> are sequentially shifted to a high level, the-second gray-scale data bits sdout<1> and sdout<10> through the ninth gray-scale data bits sdout<8> and sdout<17> are sequentially transmitted.

While the 18-bit gray-scale data is transmitted by two 9-to-1 multiplexers through two transmission lines in an exemplary embodiment of the present invention, it is to be understood that the invention may be embodied with any suitable number of multiplexers and transmission lines. For example, the 18-bit gray-scale data can be transmitted by three 6-to-1 multiplexers through three transmission lines. Furthermore, it is to be understood that the characteristics of the multiplexer and the demultiplexer can be varied to suit the number of bits of gray-scale data representing the gray scale of one pixel.

A driving IC according to an exemplary embodiment of the present invention is constructed so that the area required for the transmission lines can be reduced when a scan port of the memory is used to transmit gray-scale data. Although the area required for the transmission lines is increased slightly when using the three 6-to-1 multiplexers compared to when using the two 9-to-1 multiplexers, power loss is reduced because the 18-bit gray-scale data can be transmitted by six driving operations. In accordance with exemplary embodiments of the present invention, a driving IC can be designed in consideration of the area required for the transmission lines and power loss by controlling the characteristics of the multiplexer and demultiplexer.

Figure 6:
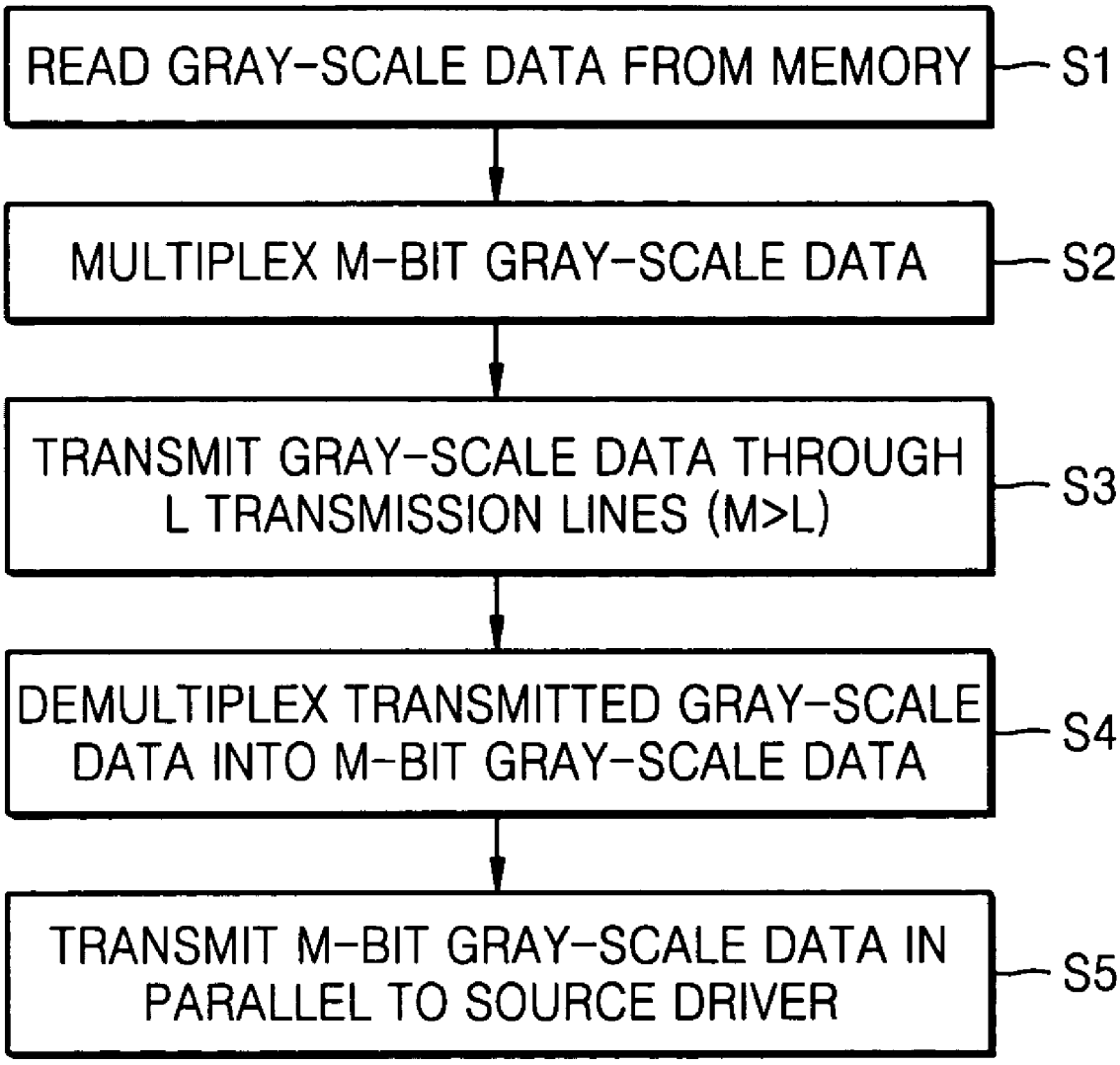
FIG. 6 is a flow chart showing a display driving method according to an exemplary embodiment of the present invention.

FIG. 6 is a flow chart showing a display driving method according to an exemplary embodiment of the present invention. Referring to FIG. 6, in step S1, the M-bit gray-scale data stored in a memory is read. Then, the M-bit gray-scale data is multiplexed in the step S2. To transmit the M-bit gray-scale data through L transmission lines, the M-bit gray-scale data can be multiplexed using L M/L-to-1 multiplexers.

The M-bit gray-scale data is transmitted through the L transmission lines according to the multiplexing operation in the step S3. In the case of the M/L-to-1 multiplexer, M/L-bit gray-scale data bits are sequentially transmitted through the transmission lines.

The gray-scale data transmitted through the transmission lines is demultiplexed into M-bit gray-scale data in the step S4. In step S5, the demultiplexed M-bit gray-scale data is transmitted in parallel to the source driver.

According to an exemplary embodiment of the present invention, the number of transmission lines for transmitting gray-scale data from a memory can be reduced to improve the integration of a driving IC. A driving IC, in accordance with exemplary embodiments of the present invention, can be designed in consideration of integration and power loss according to multiplexing and demultiplexing characteristics.

Although the exemplary embodiments of the present invention have been described in detail with reference to the accompanying drawings for the purpose of illustration, it is to be understood that the that the inventive processes and apparatus are not be construed as limited thereby. It will be readily apparent to those of ordinary skill in the art that various modifications to the foregoing exemplary embodiments can be made without departing from scope of the invention as defined by the appended claims, with equivalents of the claims to be included therein.

What is claimed is:

1. A display driving integrated circuit (IC) receiving M-bit gray-scale data to represent a gray scale of one pixel and driving a panel including a plurality of pixels, comprising:

a memory that stores gray-scale data representing gray scales of the plurality of pixels;

a source driver that receives the gray-scale data in parallel from the memory through transmission lines;

at least one multiplexer to transmit the M-bit gray-scale data representing the gray scale of one pixel time divided bit by bit through L transmission lines, wherein the value of L is smaller than the value of M, at least one demultiplexer that receives gray-scale data time divided bit by bit through the L transmission lines, that demultiplexes the received gray-scale data into M-bit gray-scale data and that transmits the M-bit gray-scale data to the source driver; and a control signal generator that generates control signals that control at least one of the multiplexer and the demultiplexer;

wherein:

the multiplexer and the demultiplexer are positioned between the memory and the source driver, each of the at least one demultiplexer sequentially receives the M/L-bit gray-scale data bit by bit through one transmission line and parallel outputs the M/L-bit gray-scale data, and the control signal generator controls the multiplexer to output the M-bit gray-scale data representing the gray scale of one pixel sequentially by L bits at a time.

2. The display driving IC of claim 1, wherein each of the at least one multiplexer receives M/L-bit gray-scale data and sequentially outputs the M/L-bit gray-scale data bit by bit through one transmission line, where M/L is an integer.

3. The display driving IC of claim 1, wherein each of the at least one demultiplexer includes at least one latch for parallel outputting the gray-scale data.

4. A display driving integrated circuit (IC) receiving M-bit gray-scale data to represent a gray scale of one pixel and driving a panel including a plurality of pixels, comprising:

a memory that stores gray-scale data representing gray scales of the plurality of pixels;

a source driver that receives the gray-scale data from the memory through transmission lines;

at least one multiplexer to transmit the M-bit gray-scale data representing the gray scale of one pixel through L transmission lines, wherein the value of L is smaller than the value of M;

at least one demultiplexer that receives gray-scale data through the L transmission lines, that demultiplexes the received gray-scale data into M-bit gray-scale data and that transmits the M-bit gray-scale data to the source driver; and a control signal generator that generates control signals that control the multiplexer and the demultiplexer such that the multiplexer and the demultiplexer transmit and receive the gray-scale data, wherein:

the multiplexer and the demultiplexer are positioned between the memory and the source driver, each of the at least one demultiplexer sequentially receives the M/L-bit gray-scale data bit by bit through one transmission line and parallel outputs the M/L-bit gray-scale data, and the control signals include M/L signals respectively transmitted through M/L lines, where M/L is an integer.

5. The display driving IC of claim 4, wherein the control signal generator generates the M/L control signals in synchronization with K input signals.

6. The display driving IC of claim 4, wherein each of the at least one multiplexer receives M/L-bit gray-scale data and sequentially outputs the M/L-bit gray-scale data bit by bit through one transmission line, where M/L is an integer.

7. The display driving IC of claim 4, wherein each of the at least one demultiplexer includes at least one latch for parallel outputting the gray-scale data.

8. A display driving IC receiving M-bit gray-scale data to represent a gray scale of one pixel and driving a panel including a plurality of pixels, comprising:

a memory that stores gray-scale data representing gray scales of the plurality of pixels;

a source driver that receives the gray-scale data in parallel from the memory through transmission lines;

at least one multiplexer that transmits the M-bit gray-scale data time divided bit by bit through the L transmission lines, the multiplexer being located between the memory and the transmission lines;

at least one demultiplexer that receives gray-scale data time divided bit by bit through the L transmission lines, that demultiplexes the received gray-scale data into M-bit gray-scale data and that transmits the M-bit gray-scale data to the source driver, and each of the at least one demultiplexer sequentially receives the M/L-bit gray-scale data bit by bit through one transmission line and parallel outputs the M/L-bit gray-scale data; and a control signal generator that generates control signals that control at least one of the multiplexer and the demultiplexer;

wherein:

the M-bit gray-scale data representing the gray scale of one pixel is transmitted through the L transmission lines, wherein the value of L is smaller than the value of M, M/L-bit gray-scale data from among the gray-scale data is time-divided and sequentially transmitted bit by bit through one of the L transmission lines, where M/L is an integer, and the control signal generator controls the multiplexer to output the M-bit gray-scale data representing the gray scale of one pixel sequentially by L bits at a time.

9. The display driving IC of claim 8, wherein each of the at least one multiplexer receives M/L-bit gray-scale data and sequentially outputs the M/L-bit gray-scale data bit by bit through one transmission line.

10. The display driving IC of claim 9, wherein each of the at least one demultiplexer includes at least one latch for parallel outputting the gray-scale data.

11. A display driving IC receiving M-bit gray-scale data to represent a gray scale of one pixel and driving a panel including a plurality of pixels, comprising:

a memory that stores gray-scale data representing gray scales of the plurality of pixels;

a source driver that receives the gray-scale data from the memory through transmission lines;

at least one multiplexer that transmits the M-bit gray-scale data through the L transmission lines, the multiplexer being located between the memory and the transmission lines;

at least one demultiplexer that receives gray-scale data through the L transmission lines, that demultiplexes the received gray-scale data into M-bit gray-scale data and that transmits the M-bit gray-scale data to the source driver, and each of the at least one demultiplexer sequentially receives the M/L-bit gray-scale data bit by bit through one transmission line and parallel outputs the M/L-bit gray-scale data; and a control signal generator that generates control signals that control the multiplexer and the demultiplexer such that the multiplexer and the demultiplexer transmit and receive the gray-scale data, wherein:

the M-bit gray-scale data representing the gray scale of one pixel is transmitted through the L transmission lines, wherein the value of L is smaller than the value of M, M/L-bit gray-scale data from among the gray-scale data is time-divided and sequentially transmitted bit by bit through one of the L transmission lines, where M/L is an integer, and the control signals include M/L signals respectively transmitted through M/L lines, where M/L is an integer.

12. The display driving IC of claim 11, wherein the control signal generator generates the M/L control signals in synchronization with K input signals.

13. The display driving IC of claim 11, wherein each of the at least one multiplexer receives M/L-bit gray-scale data and sequentially outputs the M/L-bit gray-scale data bit by bit through one transmission line.

14. The display driving IC of claim 11, wherein each of the at least one demultiplexer includes at least one latch for parallel outputting the gray-scale data.

15. A method for receiving M-bit gray-scale data to represent a gray scale of one pixel and driving a panel including a plurality of pixels, comprising:

reading gray-scale data stored in a memory;

multiplexing the read gray-scale data to transmit the M-bit gray-scale data representing the gray scale of one pixel through L transmission lines, wherein the value of L is smaller than the value of M;

transmitting the multiplexed gray-scale data through the L transmission lines;

receiving the gray-scale data through the L transmission lines and demultiplexing the received gray-scale data into M-bit gray-scale data; and parallel transmitting the demultiplexed M-bit gray-scale data to a source driver, wherein:

the multiplexing and the demultiplexing are performed by at least one multiplexer and at least one demultiplexer respectively, each of the multiplexer and the demultiplexer is controlled by M/L control signals, and the M/L control signals are respectively transmitted to each of the multiplexer and the demultiplexer through M/L lines, where M/L is an integer.

16. The method of claim 15, wherein the step of multiplexing the read gray-scale data comprises receiving M/L-bit gray-scale data and sequentially outputting the M/L-bit gray-scale data bit by bit through one transmission line, where M/L is an integer.

17. The method of claim 16, wherein the step of demultiplexing the gray-scale data comprises sequentially receiving M/L-bit gray-scale data bit by bit through one transmission line and parallel outputting the M/L-bit gray-scale data.

* * * * *